US005318308A

United States Patent [19]

Holms

[11] Patent Number: 5,318,308

[45] Date of Patent: Jun. 7, 1994

[54] BAG TOSS GAME APPARATUS

[76] Inventor: Darren M. Holms, 1108 Cornell Ave., Drexel Hill, Pa. 19026

[21] Appl. No.: 84,922

[22] Filed: Jul. 1, 1993

[51] Int. Cl.[5] ..... A63B 67/06

[52] U.S. Cl. ..... 273/346; 273/336; 273/415; 273/DIG. 30

[58] Field of Search ..... 273/346, 347, 411–415, 273/336, 337, 338, 339, DIG. 30

[56] References Cited

U.S. PATENT DOCUMENTS 1,513,968 11/1924 Crandall ..... 273/336
3,231,278 1/1966 Boulanger ..... 273/411 X
4,923,201 5/1990 Nichol et al. ..... 273/415 X
4,927,160 5/1990 Nichol et al. ..... 273/415 X
4,938,485 7/1990 Hockridge et al. ..... 273/415 X
4,943,065 7/1990 DeLapa ..... 273/415 X
4,986,549 1/1991 Kuhtic et al. ..... 273/415 X
5,067,727 11/1991 Crompton ..... 273/336

*Primary Examiner*—William H. Grieb
*Attorney, Agent, or Firm*—Leon Gilden

[57] ABSTRACT

A game structure includes mat members including ring portions arranged for selective securement to the mat members, with the ring members optionally mounted employing hook and loop fastener structure securing the ring members relative to the target structure.

2 Claims, 3 Drawing Sheets

BAG TOSS GAME APPARATUS

BACKGROUND OF THE INVENTION

1. Field of the Invention

The field of invention relates to bag toss game structure, and more particularly pertains to a new and improved bag toss game apparatus wherein the same employs portable ring members arranged for selective positioning functioning as targets to receive bean bags directed thereto.

2. Description of the Prior Art

Bean bag toss game structure is indicated in the prior art and exemplified by the U.S. Pat. Nos. 4,986,549; 4,927,160; 4,943,065; 4,923,201; and 4,938,485.

The instant invention attempts to overcome deficiencies of the prior art by providing for a bean bag toss game structure wherein the same employs bean bags of various colorations for demarcation of various players relative to the coloration and in this respect, the present invention substantially fulfills this need.

SUMMARY OF THE INVENTION

In view of the foregoing disadvantages inherent in the known types of bag toss game apparatus now present in the prior art, the present invention provides a bag toss game apparatus wherein the same employs ring structure arranged for selective mounting to an underlying target base mat. As such, the general purpose of the present invention, which will be described subsequently in greater detail, is to provide a new and improved bag toss game apparatus which has all the advantages of the prior art bag toss game apparatus and none of the disadvantages.

To attain this, the present invention provides a game structure including mat members with ring portions arranged for selective securement to the mat members, with the ring members optionally mounted employing hook and loop fastener structure securing the ring members relative to the target structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims by regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bag toss game apparatus which has all the advantages of the prior art bag toss game apparatus and none of the disadvantages.

It is another object of the present invention to provide a new and improved bag toss game apparatus which may be easily and efficiently manufactured and marketed.

It is a further object of the present invention to provide a new and improved bag toss game apparatus which is of a durable and reliable construction.

An even further object of the present invention is to provide a new and improved bag toss game apparatus which is susceptible of a low cost of manufacture with regard to both materials and labor, and which accordingly is then susceptible of low prices of sale to the consuming public, thereby making such bag toss game apparatus economically available to the buying public.

Still yet another object of the present invention is to provide a new and improved bag toss game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
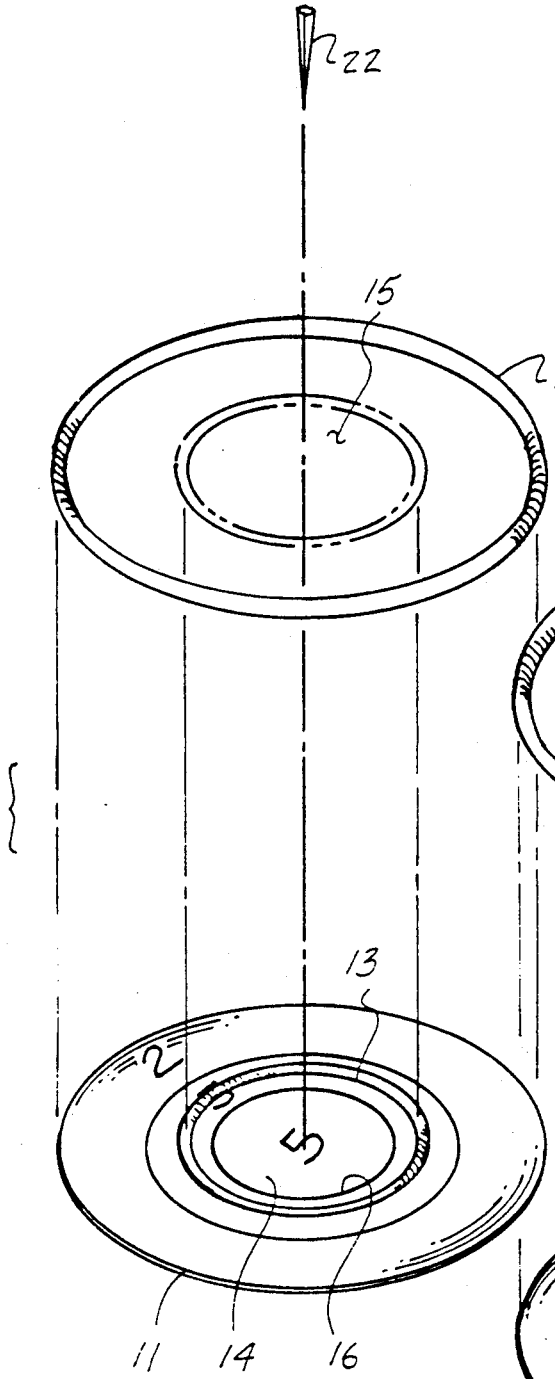
FIG. 1 is a perspective illustration of the target base mat structure.
Figure 2:
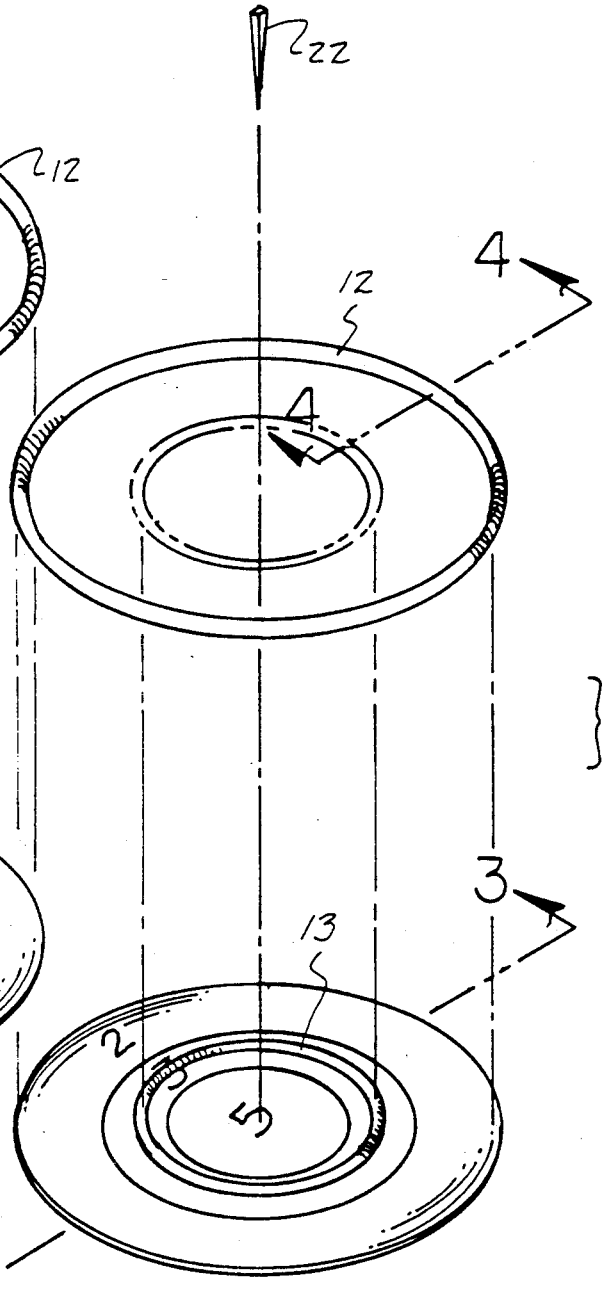
FIG. 2 is a perspective illustration of the mat structure indicating various ring members mounted thereon.
Figure 3:
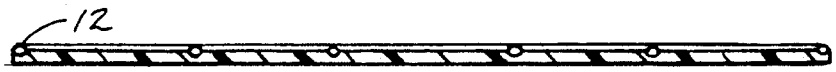
FIG. 3 is a sectional view, taken along the lines 3—3 of FIG. 2 in the direction indicated by the arrows.
Figure 4:
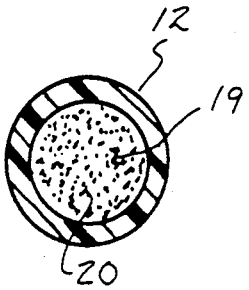
FIG. 4 is a sectional view, taken along the lines 4—4 of FIG. 2 in the direction indicated by the arrows.

With reference now to the drawings, and in particular to FIGS. 1 to 8 thereof, a new and improved bag toss game apparatus embodying the principles and concepts of the present invention and generally designated by the reference numerals 11–25 will be described.

Figure 5:
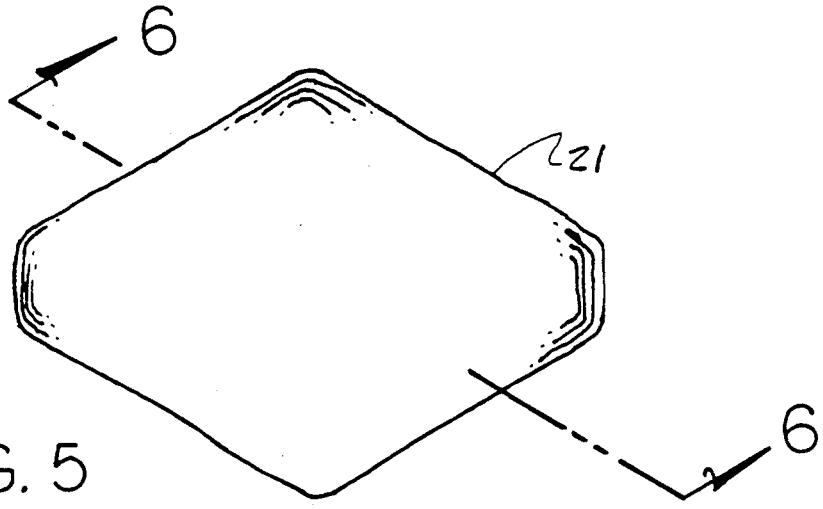
FIG. 5 is a perspective illustration of an individual bag member for use as a projectile.
Figure 6:
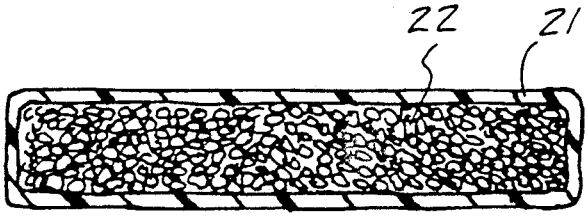
FIG. 6 is a sectional view, taken along the lines 6—6 of FIG. 5 in the direction indicated by the arrows.
Figure 8:
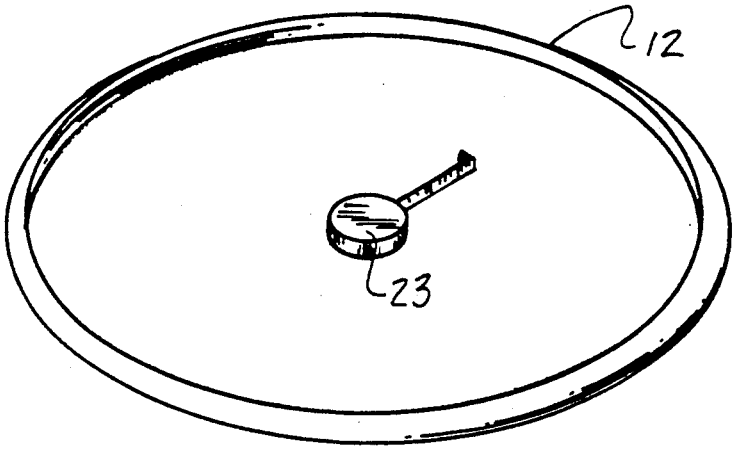
FIG. 8 is a perspective illustration of the spike member mounted within an annular target ring.
Figure 7:
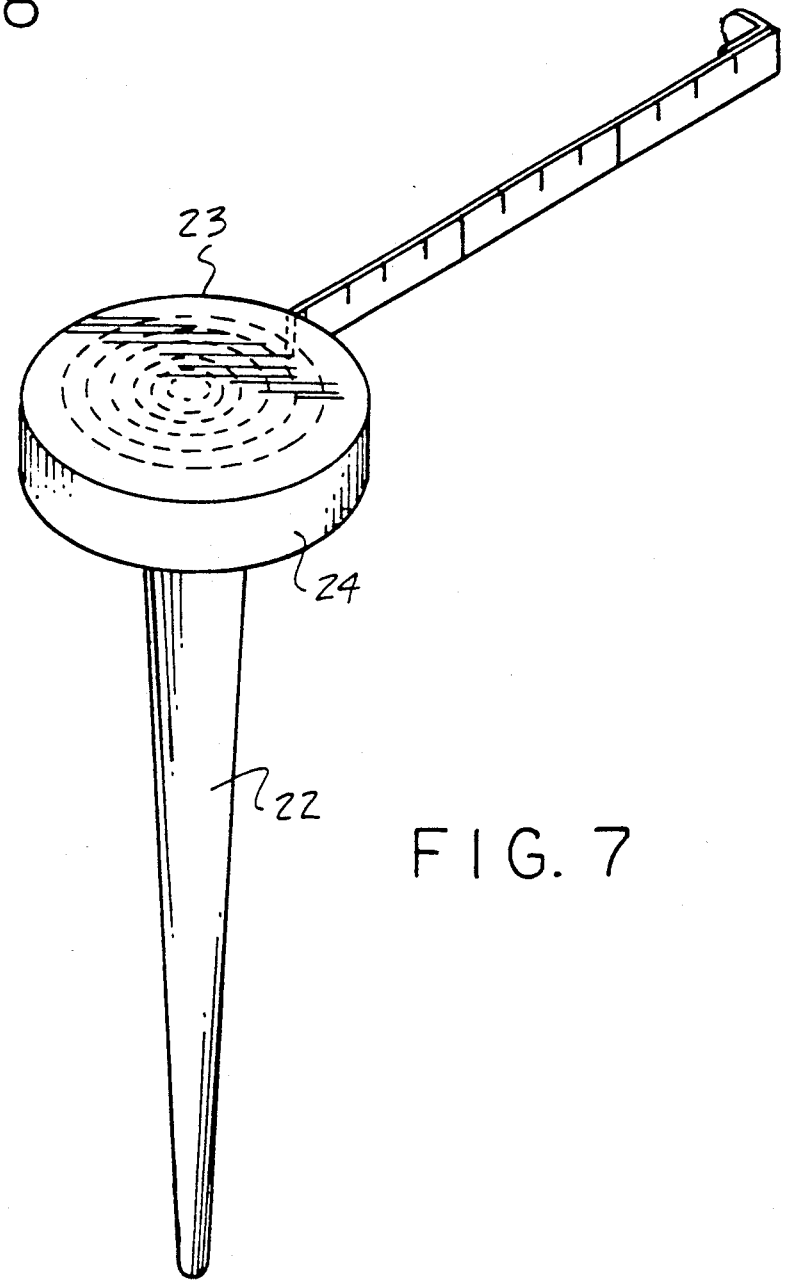
FIG. 7 is a perspective illustration of a central spike member.

More specifically, the bag toss game apparatus of the instant invention essentially comprises a flexible target base mat 11 arranged to mount a plurality of annular rings, to include annular first and second rings 12 and 13 respectively in a concentrical relationship about the base mat and about the base mat central opening 14, having a central spike 22 directed therethrough indicating a central target orientation of the structure. Bean bags are indicated in FIGS. 5 and 6, wherein a plurality of such bean bags 21 having bean bag fill 22 therewithin are employed of various colorations, wherein individual players are provided discrete and contrasting colorations for use. It is contemplated that the base mat 11 had a VELCRO coating permitting various overlays to be positioned thereon, or alternatively with the bean bag formed of a fibrous material arranged for adherence to the VELCRO covering of the target base mat 11. The annular rings include annular first and second rings 12 and 13 arranged for selective securement to provide for demarcation of various point totals with an individual of said rings, with the rings including a ring cavity 19 filled with a granular material 20. The central spike 22, as indicated in the FIGS. 7 and 8, may be provided with a spike head 23, with the spike head having an annular head side wall 24 having a flexible tape measure 25 arranged for extension and retraction relative to the head side wall 24 to permit measuring of a target directed within an individual ring, such as the ring 12, to thereby permit ascertaining as to which bean bag of a plurality of bean bags is closer to the central spike 22 to eliminate guess work.

In this manner, variations in play may be employed relative to distances and the number of attempts to throw a bean bag by individual players relative to a mat or within a central annular ring structure as indicated. Scoring may be such that contacting of the central spike 22 may be afforded five points, wherein inside the ring 12 may be three points, contact of the ring 12 two points, outside the ring one point, and a further point awarded to that player closest to the central spike 22. A predetermined number of such bean bags such as twelve may be provided to permit a plurality of players such as four players each being provided with three bean bags of a contrasting coloration relative to other players.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bag toss game apparatus, comprising, a flexible target base mat, having a mat central opening, and at least one annular ring arranged for securement to the base mat, and the annular ring including an annular ring central opening, and a central spike directed through the central opening coaxially of the annular ring and the base mat, and at least one bean bag, and said at least one bean bag arranged for projection towards the central spike, and the central spike includes a central spike head, the central spike head having a side wall and a cavity within the head, and a flexible tape measure arranged for extension and retraction relative to the cavity for measuring of said bean bag relative to said central spike.

2. An apparatus as set forth in claim 1 wherein the base mat includes a hook and loop fastener covering, and said bean bag includes a fibrous covering arranged for adherence to said hook and loop covering.

* * * * *